US007176606B2

(12) United States Patent
Schaefer et al.

(10) Patent No.: US 7,176,606 B2
(45) Date of Patent: Feb. 13, 2007

(54) LAMP THAT EMITS COLORED LIGHT

(75) Inventors: Reinhard Schaefer, Heidenheim (DE); Robert Nichols, Santa Rosa, CA (US); Florence Taitel, Hooksett, NH (US)

(73) Assignees: Patent-Treuhand-Gesellschaft fur Elektrisch Gluhlampen mbH, Munich (DE); Deposition Sciences Incorporated, Santa Rosa, CA (US)

( * ) Notice: Subject to any disclaimer, the term of this patent is extended or adjusted under 35 U.S.C. 154(b) by 344 days.

(21) Appl. No.: 10/839,259

(22) Filed: May 6, 2004

(65) Prior Publication Data

US 2004/0222727 A1 Nov. 11, 2004

Related U.S. Application Data

(60) Provisional application No. 60/487,707, filed on Jul. 16, 2003, provisional application No. 60/468,265, filed on May 7, 2003.

(51) Int. Cl.
*H01J 17/20* (2006.01)

(52) U.S. Cl. ..... 313/112; 313/634

(58) Field of Classification Search ..... 313/110, 313/112, 113, 117, 634, 635; 362/293, 361, 362/321

See application file for complete search history.

(56) References Cited

U.S. PATENT DOCUMENTS

| | | | | |
|---|---|---|---|---|
| 5,200,855 | A | 4/1993 | Meredith et al. | |
| 6,611,082 | B1 * | 8/2003 | McGuire | 313/110 |
| 6,661,164 | B2 | 12/2003 | Ruemmelin et al. | |

FOREIGN PATENT DOCUMENTS

| | | |
|---|---|---|
| EP | 0986093 | 3/2000 |
| EP | 11565514 | 11/2001 |

* cited by examiner

*Primary Examiner*—Joseph Williams
(74) *Attorney, Agent, or Firm*—Young & Thompson

(57) ABSTRACT

A lamp includes a transparent envelope having a first region defining an enclosed interior volume and a closure region adjacent to the first region, a light source in the interior volume and electrically coupled through the closure region, an interference filter coating on the exterior of the first region, and a light absorbing coating that is 7–40 nanometers thick on the exterior of the first region, except in a ring-shaped portion adjacent to the closure region that has a thickness of 50–200 nanometers.

15 Claims, 3 Drawing Sheets

LAMP THAT EMITS COLORED LIGHT

The Applicants hereby claim the benefit of their provisional applications, Ser. No. 60/468,265 filed on May 7, 2003 for RED, ORANGE AND YELLOW EMITTING LAMP BURNERS WITH IMPROVED COLOR PURITY AND LUMEN OUTPUT and Ser. No. 60/487,707 filed on Jul. 16, 2003 for LAMP FOR GENERATING COLORED LIGHT.

BACKGROUND OF THE INVENTION

1. Field of the Invention

The invention relates to a lamp for generating colored light, preferably red or amber light, the lamp having an interference filter coating and a light absorbing coating formed on the exterior of its transparent envelope. Such a lamp is used for taillights, brake lights or indicator lights, daytime running lights or parking lights of motor vehicles.

2. Description of the Related Art Including Information Disclosed Under 37 CFR 1.97 and 1.98

European laid-open specification EP 0 986 093 A1 discloses an incandescent lamp whose transparent lamp vessel has an interference filter coating and a light absorbing coating for emitting red or amber light. The light absorbing coating consists of a single layer of iron oxide $Fe_2O_3$ having a thickness in the range of 5.4 nanometer to 5.8 nanometer.

European laid-open specification EP 1 156 514 A1 (U.S. Pat. No. 6,661,164) describes an incandescent lamp whose transparent envelope has an interference coating and a light absorbing coating for emitting red light. The light absorbing coating comprises two layers of iron oxide $Fe_2O_3$ separated by one layer of silicon dioxide wherein the thickness of the iron oxide layers is 8 nanometer and 14 nanometer respectively.

U.S. Pat. No. 5,200,855 describes the use of multi-layer interference coatings where the layers of high optical refraction of the interference coating are formed from iron oxide $Fe_2O_3$ which is a material with high absorption in the shorter visible wavelengths. The referenced patent does not teach the utility of using deliberately non-uniform thickness of the absorbing material to provide the desired color purity while minimizing lumen reductions due to the absorbing layer. Lamp envelopes coated with an interference filter according to the afore-said patent would have undesirably low lumen output due to the absorption of the multiple layers of absorbing material.

BRIEF SUMMARY OF THE INVENTION

It is an object of the invention to provide an improved lamp for generating colored light. In particular, it is the object of the invention to provide a lamp with reduced light output from undesirable spectral regions.

This object is achieved by a lamp comprising a transparent envelope having a first region defining an enclosed interior volume, and a second region constructed as a closure region and located adjacent said first region, a light source located in said interior volume and electrically coupled to the exterior through said closure region, an interference filter coating formed on the exterior of said first region, said interference filter coating defining a spectral region of transparency, and a light absorbing coating formed on the exterior of said first region, wherein said light absorbing coating comprises a ring-shaped portion having a layer thickness of at least 20 nanometer and preferably in the range of 50 nanometer to 200 nanometer.

The lamp according to the invention only emits light from the spectral region of transparency, which is determined by the properties of the interference filter coating. Light from other spectral regions than the spectral region of transparency generated by the light source is blocked by the interference filter coating. Therefore, the color of the light emitted by the lamp is essentially determined by the interference filter coating. Depending on the shape of the first region and on the position of the light source in respect of the first region light of different angles of incidence impinge on the interference filter coating. Since the transparency of the interference filter coating varies with the angle of incidence of the light impinging on the interference filter coating, some light of spectral regions outside of the spectral region of transparency of the interference filter coating is transmitted by the interference filter coating due to the fact that light generated by different portions of the light source impinges from several angles of incidence on each location of the interference filter. The color change in the light increases with the angle of incidence. This makes the construction of a lamp with a required color range difficult using an interference filter coating. The light absorbing coating of the lamp according to the invention serves for absorption of the light outside of the spectral region of transparency of the interference filter coating and provides a light output of uniform color. In accordance with the invention, said light absorbing coating comprises a ring-shaped portion having a layer thickness of at least 20 nanometer, and preferably in the range of 50 nanometer to 200 nanometer. The thickness of the ring-shaped portion of said light absorbing coating preferably does not exceed 200 nanometer to avoid a considerable reduction of light output of the lamp. On the other hand, the thickness of the ring-shaped portion of said light absorbing coating does not fall below 20 nanometer, and preferably not below 50 nanometer, to provide sufficient absorption of light outside of the spectral region of transparency of the interference filter coating.

Advantageously, the width of the ring-shaped portion of the light absorbing coating mentioned above is in the range of 5 millimeters to 20 millimeters and said ring-shaped portion of the light absorbing coating is preferably located at a distance in the range of 0 millimeters to 10 millimeters from the enclosure region of the lamp's envelope. These measures ensure that most of the light outside of the spectral region of transparency defined by the interference filter coating is blocked by the light absorbing coating, and that on the other hand only a small portion of the light of the spectral region of transparency defined by the interference filter coating is absorbed by the light absorbing coating. According to the most preferred embodiment of the invention the light absorbing coating comprises iron oxide $Fe_2O_3$ and is designed as a single layer. Preferably, the light absorbing coating is adjacent the envelope and the interference filter coating overlaps the light absorbing coating. Advantageously, the light absorbing coating is extended to the whole first region of the envelope. But the thickness of the portion of the light absorbing coating covering the remainder of the first region is much less than the thickness of the above-mentioned ring-shaped portion of the light absorbing coating to provide for a high output of light of uniform color. The thickness of the light absorbing coating, which covers the afore-said remainder of the first region, is preferably in the range of 7 nanometer to 40 nanometer. The afore-said first region may be a bulbous region or a tubular region or may have any other desired shape.

To provide a lamp suitable for use in brake lights, tail lights or indicator lights, daytime running lights or parking lights the interference filter coating is constructed to define a spectral region of transparency comprising at least the spectral region of red light and preferably, the spectral region of red and yellow light. According to the most preferred embodiment of the invention the interference filter coating comprises a multi-layer structure which is transparent for light with wavelengths longer than 550 nanometer and which is opaque for light with wavelengths shorter than 550 nanometer. The invention is not restricted to the preferred embodiment described below. Other interference filter coatings, for example defining another spectral region of transparency, may be used to provide a lamp emitting light of any other desired color.

DETAILED DESCRIPTION OF THE INVENTION

Figure 1:
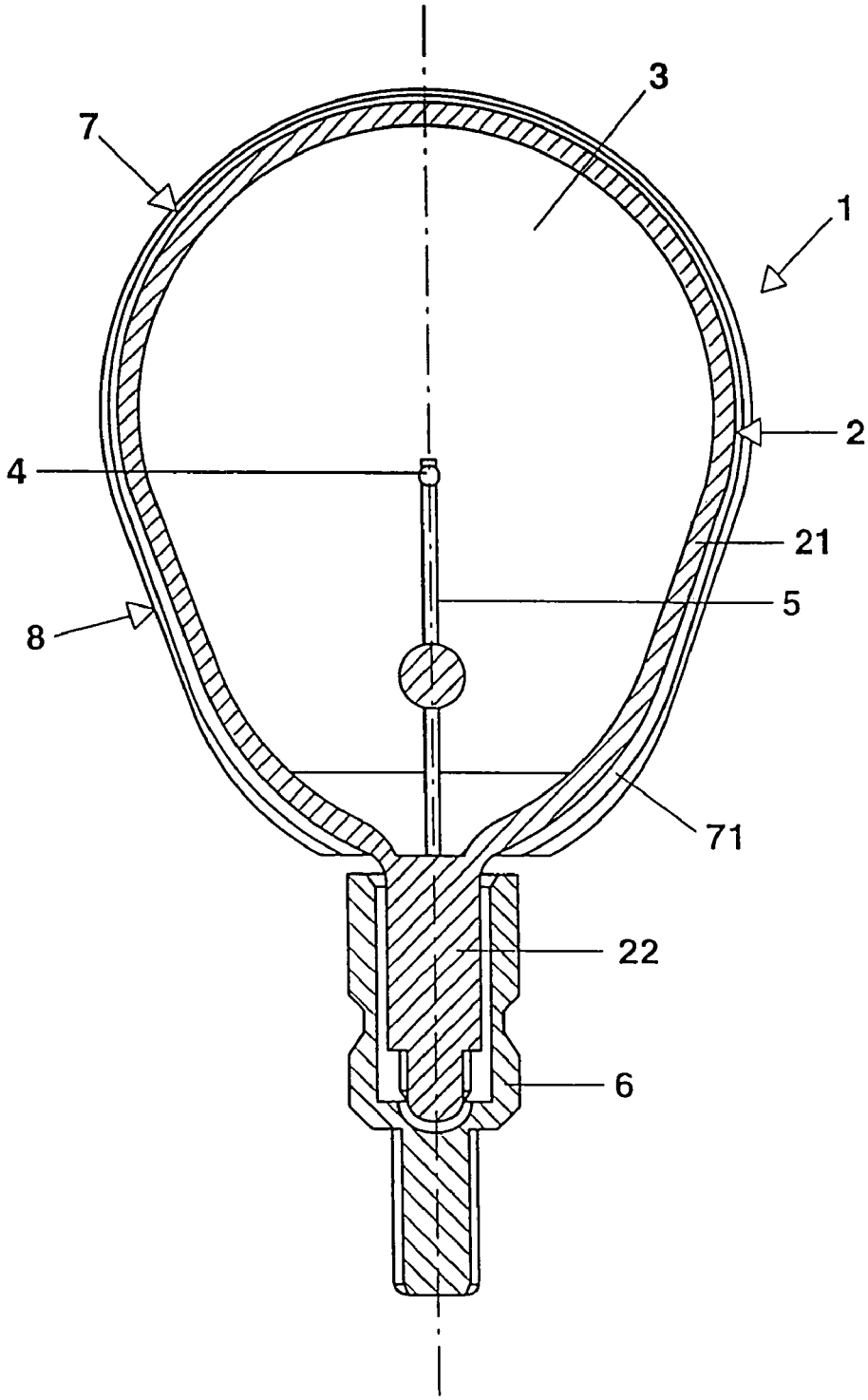
FIG. 1 shows a schematic cross section of a lamp in accordance with the preferred embodiment of the invention.
Figure 2:
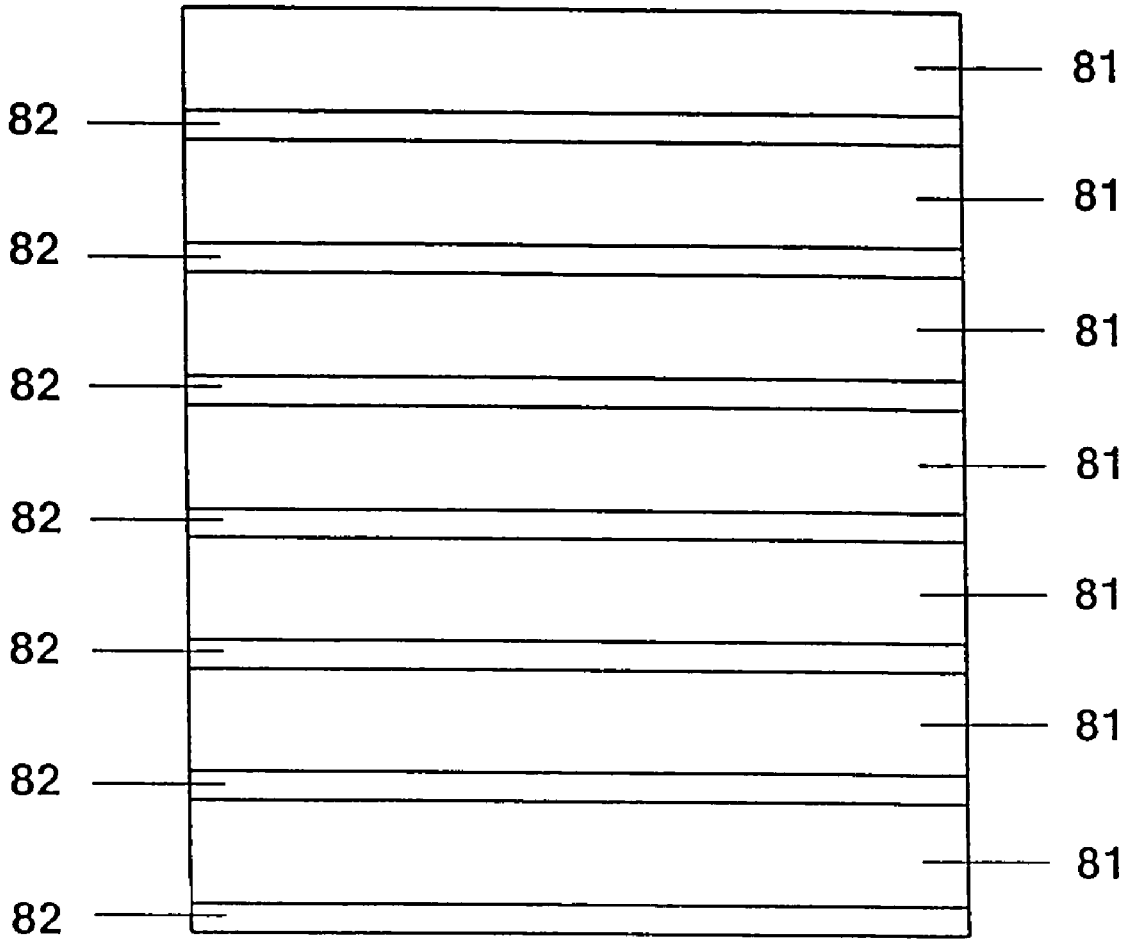
FIG. 2 shows a schematic illustration of the dichroic coating of the lamp of FIG. 1 on an enlarged scale.

FIG. 1 shows a schematic cross section of an S8-wedge-type incandescent lamp 1 for generating amber light. The lamp 1 is suitable for use as an indicator light or a warning light of motor vehicles. The lamp 1 comprises an envelope 2 made of glass having a bulbous region 21 defining an enclosed interior volume 3 and a closure region 22 adjacent said bulbous region 21. The height of the bulbous region 21, that is, the distance of the round end of the bulbous region 21 from the closure region 22, is 31.5 millimeters. A coiled filament 4 serving as a light source is located in the interior volume 3 of the bulbous region 21 closely to the center thereof. The filament 4 is electrically coupled to the exterior through the closure region 22 by current lead-in conductors 5. The closure region 22 is provided with a base capsule 6 made of plastics.

Figure 3:
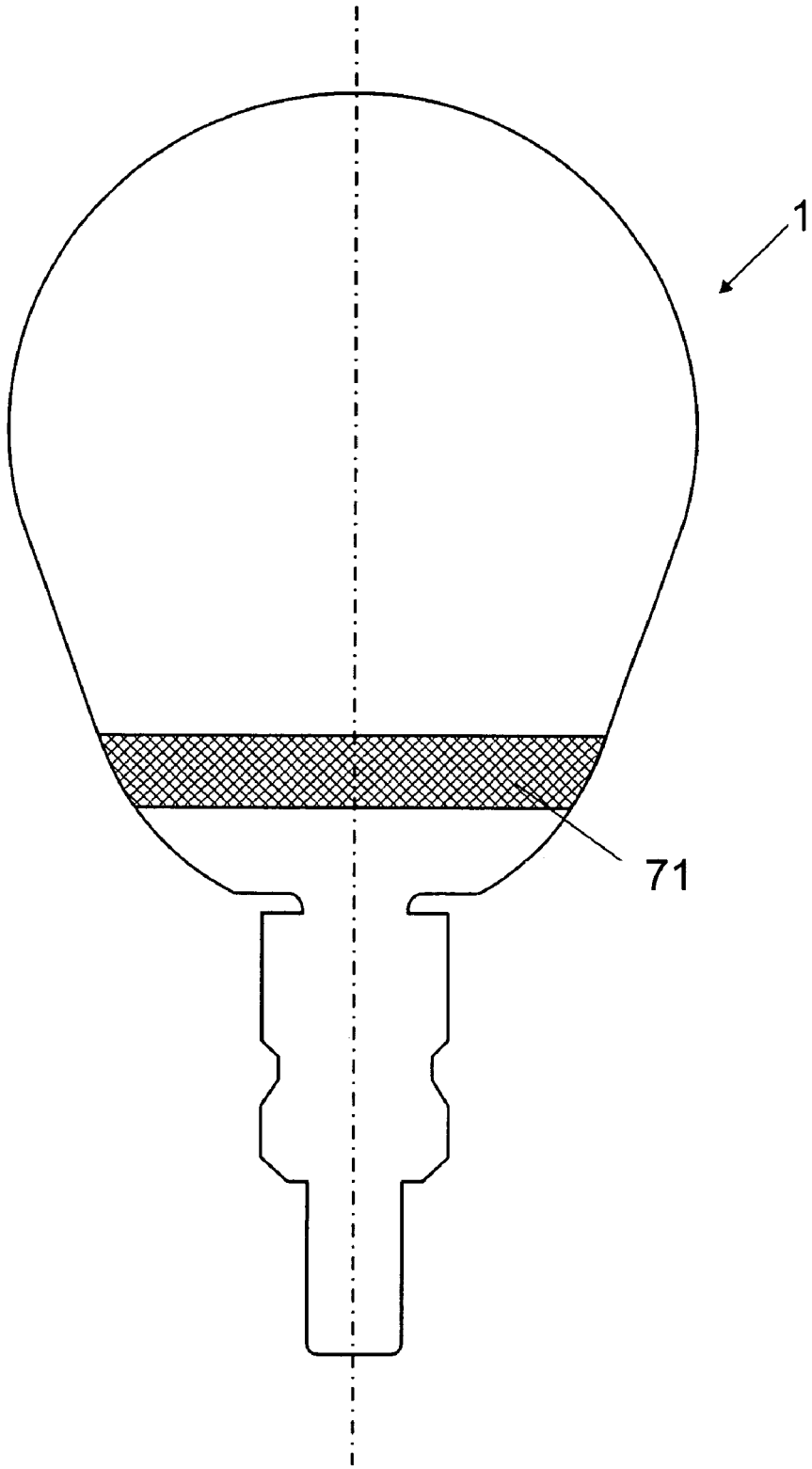
FIG. 3 shows the ring-shaped portion of the light absorbing coating.

The outer surface of the bulbous region 21 may be completely coated with a light absorbing coating 7 consisting of a single layer of iron oxide $Fe_2O_3$. As may be seen in FIG. 3, the light absorbing coating 7 includes a ring-shaped portion 71 extending on the envelope surface on the bulbous region 21, symmetrically around the lamp axis and adjacent where the bulbous region 21 and the closure region 22 meet. The coating 7 has a substantially increased layer thickness. The afore-said ring-shaped portion 71 of the light absorbing coating 7 is located at a distance of 10 millimeters from the closure region 22 and having a width of about 10 millimeters. The layer thickness of the ring-shaped portion 71 of the light absorbing coating 7 is 120 nanometer on the average. The thickness of the light absorbing coating 7 outside of the afore-said ring-shaped portion 71 is approximately 20 nanometer on average. The ring-shaped portion 71 may have a thickness in the range of 50 to 200 nanometers, a width in the range of 5 to 20 millimeters, and may be located at a distance in the range of 0 to 10 millimeters from the closure region 22. The light absorbing coating 7 may cover the whole bulbous region 21 and have a thickness outside the ring-shaped portion 71 that is in the range of 7 to 40 nanometers.

The light absorbing coating 7 is covered by an interference filter coating 8 which is extended on the whole bulbous region 21. The preferred embodiment has a multi-layer structure of fourteen alternating layers of low and high optical refraction. The layers 81 of low optical refraction are made of silicon oxide $SiO_2$ and the layers 82 of high optical refraction are made of titanium oxide $TiO_2$ or niobium oxide $Nb_2O_5$ or tantalum oxide $Ta_2O_5$. The interference filter coating 8 is designed as an spectral edge filter which substantially transmits visible light with wavelengths longer than 550 nanometer and which substantially blocks visible light with wavelengths shorter than 550 nanometer. That means the interference filter coating 8 is essentially transparent for the spectral region of red and yellow light, has a substantially reduced transparency for green light and is essentially opaque for the spectral region of blue and violet light. Such an interference filter coating 8 has been described by European laid-open specification EP 0 986 093 A1. It produces an amber colored light. The ring-shaped portion 71 of the light absorbing coating 7 substantially serves to absorb green light. The remaining portion of the light absorbing coating 7 reduces the dependency of the transparency of the interference filter coating 8 on the angle of incidence of light impinging on the interference filter coating 8. The incandescent lamp 1 generates amber light.

The invention is not restricted to the preferred embodiment described above. If for example red light is required, then the interference filter coating 8 of the lamp 1 may be replaced by the interference filter coating described in European laid-open specification EP 1 156 514 A1 which is designed as an edge filter (sharp wavelength cut off filter) generally transmitting light with wavelengths longer than 590 nanometer and blocking light with wavelengths shorter than 590 nanometer. Furthermore, the light source of the lamp according to the invention may also comprise two filaments serving for different purposes instead of only one as described above. For instance, the first filament may serve as a brake light and the second filament may serve as a taillight or the first filament may serve for generating the indicator light and the second filament may serve for generating the daytime running light of the motor vehicle.

What is claimed is:

1. A lamp comprising:

a transparent envelope having a first region symmetric about an axis, defining an enclosed interior volume, and a second region constructed as a closure region and located adjacent said first region, a light source located in said interior volume and electrically coupled to the exterior through said closure region, an interference filter coating formed on the exterior of said first region, said interference filter coating defining a spectral region of transparency, a light absorbing coating formed on the exterior of said first region, wherein said light absorbing coating comprises a ring-shaped portion encircling a portion of the first region adjacent the closure region, said ring-shaped portion having a thickness in the range of 50 to 200 nanometers, a width in the range of 5 to 20 millimeters, and being located at a distance in the range of 0 to 10 millimeters from said closure region.

2. The lamp of claim 1, wherein said light absorbing coating has an average layer thickness of about 20 nanometer outside of said ring-shaped portion.

3. The lamp of claim 1, wherein said light absorbing coating comprises iron oxide ($Fe_2O_3$).

4. The lamp of claim 1, wherein said light absorbing coating comprises a single layer structure.

5. The lamp of claim 1, wherein said spectral region of transparency comprises at least the spectral region of red light.

6. The lamp of claim 5, wherein said spectral region of transparency comprises the spectral region of red and yellow light.

7. The lamp of claim 1, wherein said interference filter coating comprises a multi-layer structure which is essentially transparent for light with wavelengths longer than 550 nanometer and which is essentially opaque for light with wavelengths shorter than 550 nanometer.

8. The lamp of claim 1, wherein said light absorbing coating covers the whole first region and wherein the thickness of the light absorbing coating outside said ring-shaped portion is in the range of 7 nanometer to 40 nanometer.

9. The lamp of claim 1, wherein said light absorbing coating is adjacent the envelope and said interference filter coating overlaps the light absorbing coating.

10. The lamp of claim 1, wherein said closure region is provided with a base capsule.

11. A lamp comprising:

a transparent envelope having a first region defining an enclosed interior volume and a closure region adjacent to said first region;

a light source in said interior volume and electrically connected through said closure region;

an interference filter coating on an exterior of said first region, said interference filter coating defining a spectral region of transparency; and a light absorbing coating on the exterior of said first region, said light absorbing coating having a thickness of 7 to 40 nanometers except in a ring-shaped portion encircling a portion of the first region adjacent to said closure region, said ring-shaped portion having a thickness of 50 to 200 nanometers.

12. The lamp of claim 11, wherein said ring-shaped portion has a width of 5 to 20 millimeters.

13. The lamp of claim 12, wherein said ring-shaped portion is located at a distance of 0 to 10 millimeters from said closure region.

14. The lamp of claim 11, wherein said light absorbing coating has an average layer thickness of about 20 nanometers outside of said ring-shaped portion and said ring-shaped portion has an average thickness of about 120 nanometers and is located at a distance of 0 to 10 millimeters from said closure region.

15. The lamp of claim 14, wherein said light absorbing coating comprises iron oxide ($Fe_2O_3$).

* * * * *